US006324883B1

(12) United States Patent
Rennehvammen

(10) Patent No.: US 6,324,883 B1
(45) Date of Patent: Dec. 4, 2001

(54) METHOD AND TOOL FOR FORMATION OF AN ENLARGED END PORTION OF A BAR

(75) Inventor: Knut Rennehvammen, Veggli (NO)

(73) Assignee: Kongsberg Automotive ASA, Kongsberg (NO)

( * ) Notice: Subject to any disclaimer, the term of this patent is extended or adjusted under 35 U.S.C. 154(b) by 0 days.

(21) Appl. No.: 09/601,476

(22) PCT Filed: Feb. 2, 1999

(86) PCT No.: PCT/NO99/00031

§ 371 Date: Sep. 27, 2000

§ 102(e) Date: Sep. 27, 2000

(87) PCT Pub. No.: WO99/39850

PCT Pub. Date: Aug. 12, 1999

(30) Foreign Application Priority Data

Feb. 3, 1998 (NO) ..... 19980469

(51) Int. Cl.[7] ..... B21D 37/16

(52) U.S. Cl. ..... 72/342.1; 72/342.94; 72/354.6; 72/364; 72/370.1; 72/377

(58) Field of Search ..... 72/342.1, 342.94, 72/353.2, 354.6, 355.2, 355.4, 355.6, 357, 364, 370.1, 377; 29/517, 520

(56) References Cited

U.S. PATENT DOCUMENTS

| | | | | |
|---|---|---|---|---|
| 2,442,142 | | 5/1948 | Nettenstrom . | |
| 2,836,706 | * | 5/1958 | Cavanaugh | 72/342.1 |
| 3,487,196 | * | 12/1969 | Bachmann | 72/342.1 |
| 4,214,358 | * | 7/1980 | Clerc | 29/520 |
| 4,571,977 | | 2/1986 | Ueno et al. . | |
| 4,598,857 | * | 7/1986 | Matsui | 228/132 |
| 4,838,062 | | 6/1989 | Prenn . | |
| 5,832,588 | * | 11/1998 | Ridenour et al. | 29/516 |

FOREIGN PATENT DOCUMENTS

| | | | | |
|---|---|---|---|---|
| 1175917 | | 4/1959 | (FR) . | |
| 60-196243 | * | 10/1985 | (JP) | 72/377 |
| 1375391 | * | 2/1988 | (SU) | 72/342.94 |
| 1690935 | * | 11/1991 | (SU) | 72/377 |

OTHER PUBLICATIONS

Urals Pipe Ind. Res., "Thickened–End Tube Making Process—Involves Preheating Front End of Blank Out of Contact with Stop Before Applying Axial Force to Rear End", Derwent Abstract No. 90–303344/40 of SU 1547932, Derwent Publications Ltd., London, (1990).

Pipe Ind. Res. Inst., "Material Local Thickening of Rod or Pipe Type of Components—Involves Heating of Deformation Zone, Twisting and Application of Axial Compression Forces", Derwent Abstract No 92–329473/40 of SU 1697967, Derwent Publications Ltd., London, (1991).

* cited by examiner

*Primary Examiner*—Ed Tolan
(74) *Attorney, Agent, or Firm*—Finnegan, Henderson, Farabow, Garrett & Dunner, L.L.P.

(57) ABSTRACT

A method and apparatus for the formation of an enlarged end portion of a bar (48) by upset forging. Before upsetting, the bar end portion (46) is heated to a forging temperature and passed through a passage (40) of a form part (2,4) and into a cavity (44) with increased cross-sectional area which is defined by the form part (2,4). The portion of the cavity (44) which is located opposite the passage (40) is defined by wall (42) with a shape corresponding to the cavity's (44) cross section. For the formation of the enlarged end portion, the wall (42) is pressed against the end of the bar and upsets the bar end portion until the bar material fills the cavity (44). According to the method a bar portion which is located in the passage (40) is also heated to forging temperature, and the form part (2,4) is moved simultaneously with the wall (42), whereby this bar portion (48) is successively fed into the cavity (44) during the upsetting process.

4 Claims, 4 Drawing Sheets

METHOD AND TOOL FOR FORMATION OF AN ENLARGED END PORTION OF A BAR

This application is a 35 USC 371 of PCT/No. 99/00031 filed Feb. 2, 1999.

The invention relates to a method for formation of an enlarged end portion of a bar by upset forging. The invention further relates to a tool for implementing the method.

From "Handbuch des Schmiedes", Hans W. Haller, Carl Hanser Verlag 1971, pages 462, 463, it is known that a bar can be secured in the passage of the form part and that the entire portion which has to be upset extends into the cavity, whereby the bar has a full, circular cross section and the enlarged end portion has a larger diameter than the bar.

The volume of the enlarged end portion hereby corresponds to the volume of the bar portion which was initially located in the cavity. If the enlarged end portion is going to be large, the non-upset end portion of the bar must be correspondingly long, and particularly if the length of the non-upset end portion exceeds a length which is approximately six times diameter of the bar, there is a risk that during the initial upsetting, i.e. during the influence of a central buckling load which is exerted by the above-mentioned wall or wall part, the bar portion will be bent outwards and come into contact with the cavity's side wall. It is possible that the bar portion may be bent in the cavity. As the upsetting continues, therefore, folded bar portions may come into contact with one another without these sides being completely joined. The completed, enlarged bar portion may consequently be very unhomogeneous with pronounced fault lines or surfaces. If this bar is a part of a supporting structure, it will be understood that the occurrence of such weakened portions can be unacceptable and that the use of such a method may lead to a large percentage of rejected products during a production.

The object of the invention is to provide a method and a tool of the above-mentioned type which is not encumbered with this disadvantage.

The characteristic of the method according to the invention is presented by the characteristic features indicated in the claims.

The invention will now be described in more detail with reference to the drawing which schematically illustrates embodiments of the tool according to the invention.

Figure 1:
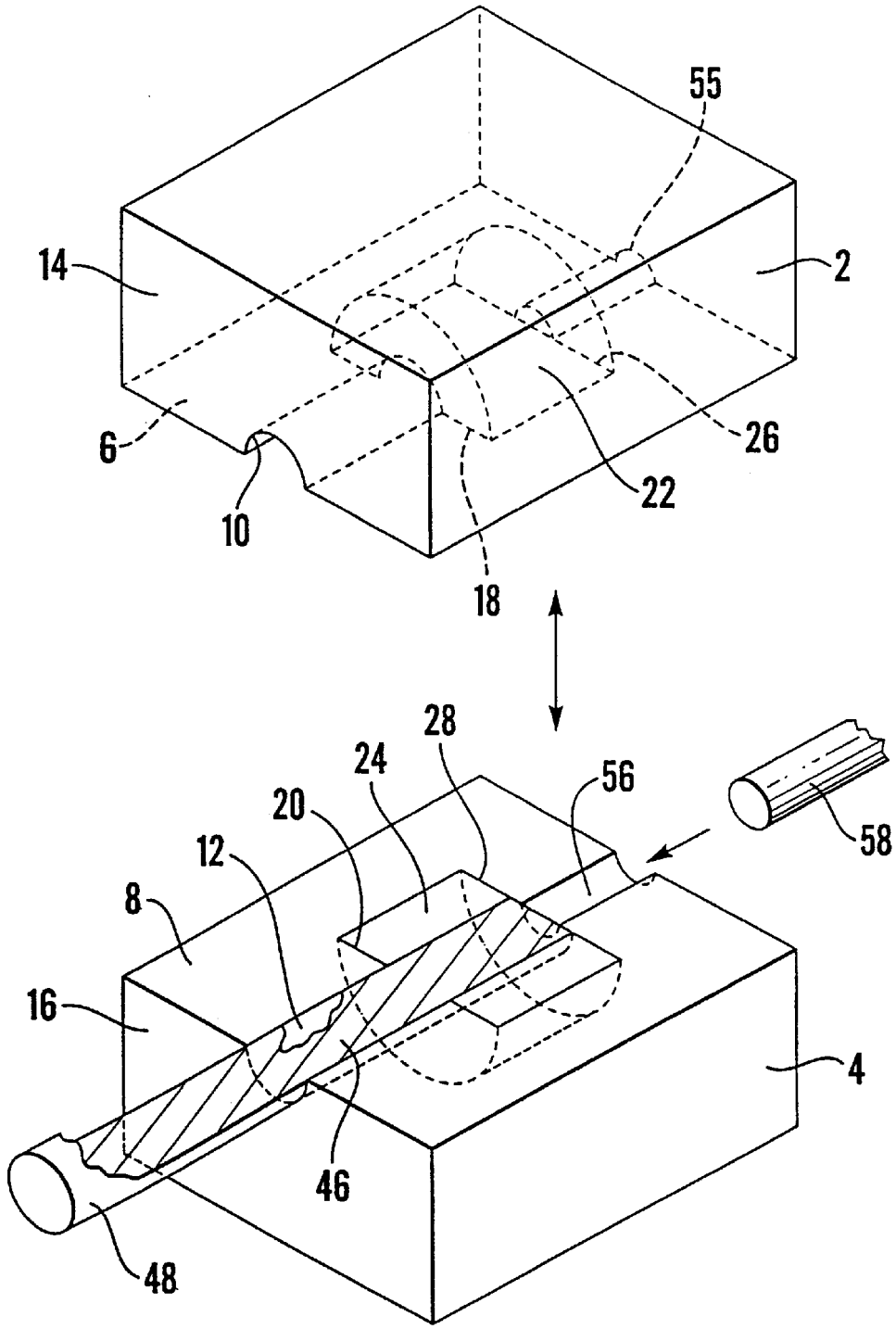
FIG. 1 is a perspective view of a first embodiment of a tool, where halves thereof have been separated from each other, and into the tool is inserted a bar, from which a portion is cut away.

As illustrated in FIGS. 1–4 the tool comprises an upper half 2 and a lower half 4 with respective contact faces 6, 8 which are arranged for mutual contact when the halves 2, 4 are joined.

In each of the tool halves there is provided a channel-shaped passage portion 10 and 12 respectively which extends from a side wall 14 and 16 respectively of the tool halves and is terminated at a point 18 and 20 respectively located at a distance from this side wall. In the figure the passage portions have a semicircular cross section, but may have a cross section which differs from this shape.

At the point 18, 20 each of the passage portions 10, 12 changes into an extended portion or compartment 22 and 24 respectively which extends to a point 26 and 28 respectively in the tool halves 2, 4. At these points the extended portions 22, 24 are thereby defined by respective wall portions 30 and 32 respectively of the tool halves 2, 4.

Figure 3:
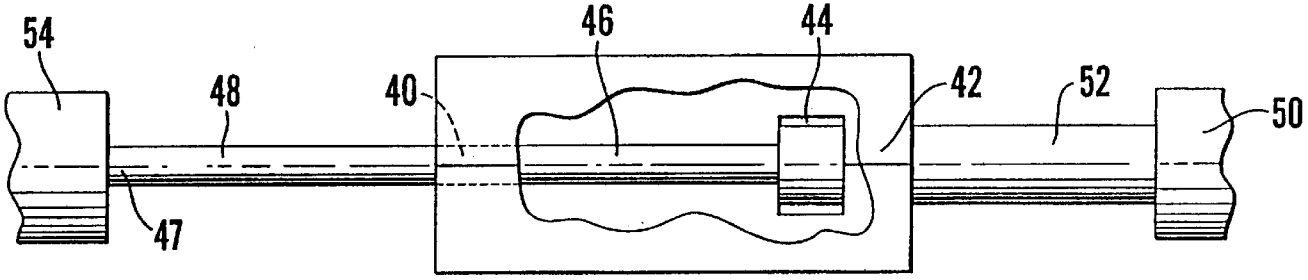

When the tool halves 2, 4 are joined, the passage portions 10, 12 form a passage 40, the wall portions form a wall or wall part 42, and the extended portions or compartments 22, 24 form a cavity 44 (FIG. 3). Thus the tool half assembly comprises a portion corresponding to the form part and the wall part described at the beginning.

Into the passage 40 is inserted a first end portion 46 of a bar 48, whose cross section is adapted to the cross section of the passage 40, with a portion 39 of the bar 48 also projecting through the cavity 44 and abutting against the wall 42. The bar 48 is made of a material which can be made plastic by heating, e.g. forgeable steel.

Against the outwardly facing side of the wall 42 there abuts a first piston 52 of a jack, such as a hydraulic cylinder 50. The second end portion 47 of the bar 48 abuts against a stop 54.

Through the wall 42 there is provided a boring 56 (only shown in FIG. 1) which extends parallel to the passage's longitudinal axis, and wherein there is slidably arranged a second piston or punch 58 which can be moved in this axial direction by means of a jack (not shown) which, e.g., may be disposed inside the first piston 52. By means of this jack an end portion of the piston 58 can be moved between a first position wherein it projects into the cavity 44, and a second position wherein it does not project into the cavity 44, as the piston's end surface can then, e.g., be level with the surface of the wall 42 which faces the cavity 44.

Instead of the stop 54, there may be provided two additional tool halves and possibly an additional hydraulic cylinder (not shown), these being rotated 180° C. relative to the tool 2, 4, and the hydraulic cylinder 50 and the second end portion of the bar 48 extend into these additional tool halves in the same way as that described above in connection with the first end portion.

Figure 2:
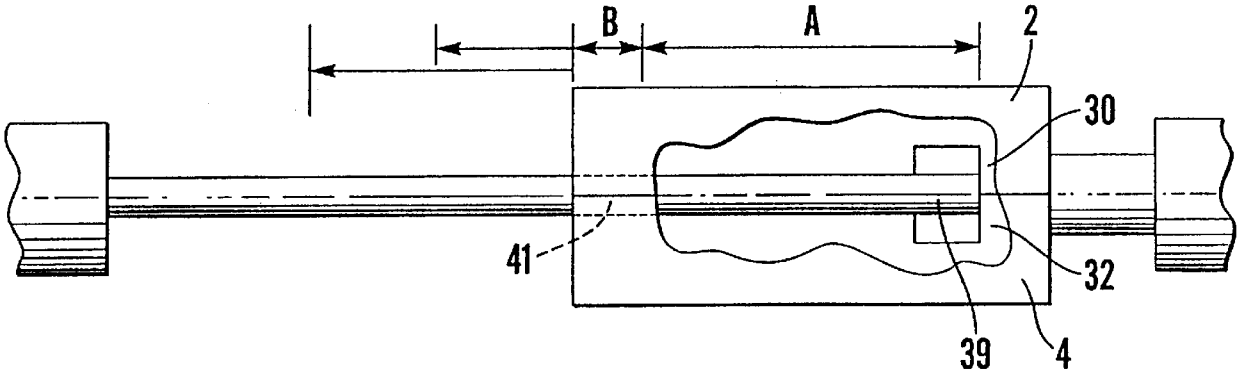
FIGS. 2–4 are side views of an upset tool of the type which is illustrated in FIG. 1, and a bar inserted in the tool, where a portion of the tool is cut away, the views illustrating the position of the parts during the upsetting process, and more specifically immediately before the upsetting is started, halfway through the upsetting process and after the upsetting is concluded respectively.
Figure 4:
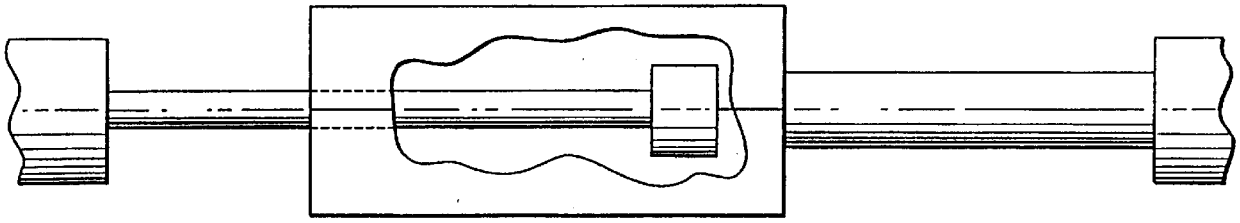

The function of the tool is as follows, with reference to FIGS. 2–4 which illustrate various stages of the upsetting process for the bar, and assuming that the bar is made of forgeable steel.

To begin with an end portion with length A of the bar 48 is heated to forging temperature, i.e. the temperature at which forging can be carried out. This can be performed by means of induction heating. This end portion is then placed in the passage 40, e.g. when the tool halves are separated, whereupon they are connected to each other, or by the bar being inserted axially into the passage 40, the first end of the bar being brought into abutment against the wall 42. The length A of this end portion is less than the total length of the passage 40 and the cavity 44, and a bar portion with length B which has not been heated to forging temperature extends in the remaining portion or an inlet portion 41 of the passage 40.

The second end portion 47 of the bar is then brought into abutment against the stop 54 and the first piston 52 brought into abutment against the outside of the wall 42. If a boring is provided in the wall 42 and a second piston 58, this piston 58 may be brought into a position, wherein its end is aligned with the inside of the wall 42. This relative position of the components forms an initial position immediately before the upsetting or forging process begins.

The hydraulic cylinder 50 is then activated, whereby the piston 52 forces the tool 2, 4 in the direction of the stop 54. During the following relative movement of the tool 2, 4 and the bar 48, bar portions which are at forging temperature and which are located closest to the cavity are consecutively brought into the cavity 44 where they are upset, as illustrated in FIG. 2, while those portions of the bar which are at forging temperature, but which are located in the passage 40 are not upset. Since bar portion 41 which is not at forging temperature is initially located in the inlet portion of the passage, it is ensured that the portion of the bar which is located outside the tool 2, 4 is not upset.

When the piston 52 has moved the tool 2, 4 to the position illustrated in FIG. 3, such a large part of the bar has been upset that the cavity 44 has become filled with bar material.

If a second piston 58 is provided, this can be moved during forging into the cavity 44, with the result that it has reached its end position before the cavity 44 has become filled. An axially extending recess is thereby obtained in the forged material. After forging the second piston 58 can be withdrawn from the cavity 44.

The tool halves 2, 4 can then be separated and the bar removed therefrom.

If an additional tool or tool halves are provided as mentioned above, both end portions of the bar can be heated to forging temperature and placed in the respective passages. The total travel distance for the first piston is then double the distance travelled by the piston when only one tool 2, 4 is provided. It will be understood that the central point between the bar ends is then moved to the left in FIGS. 2–4. In order to ensure that the bar is not moved during upsetting of both bar end portions, instead of the stop 54 an additional hydraulic cylinder can be provided, since the travel distance for the hydraulic cylinders' pistons can be fixed, e.g., by providing stops for them. This can facilitate handling of the bar if it is processed in an automated production line.

Figure 5:
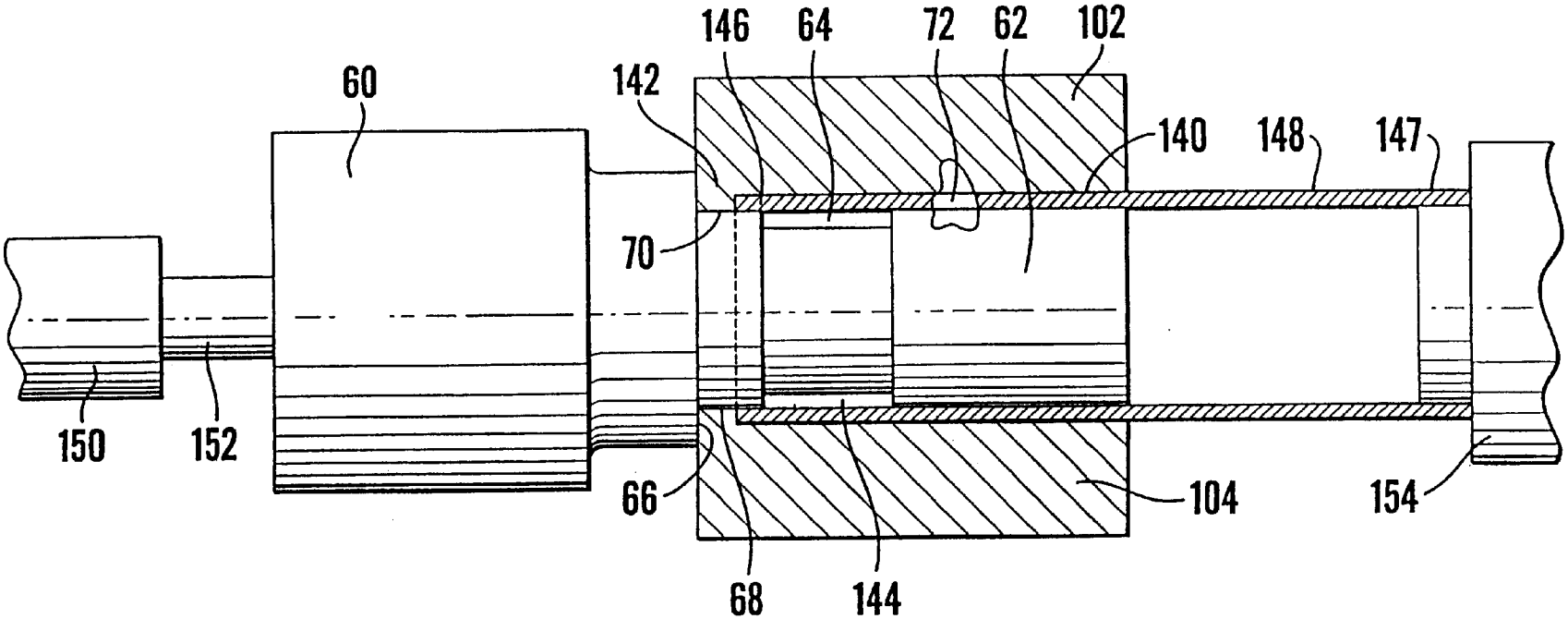
FIG. 5 is a longitudinal section through a second embodiment of a tool according to the invention, where a tubular bar is inserted in the tool.
Figure 6:
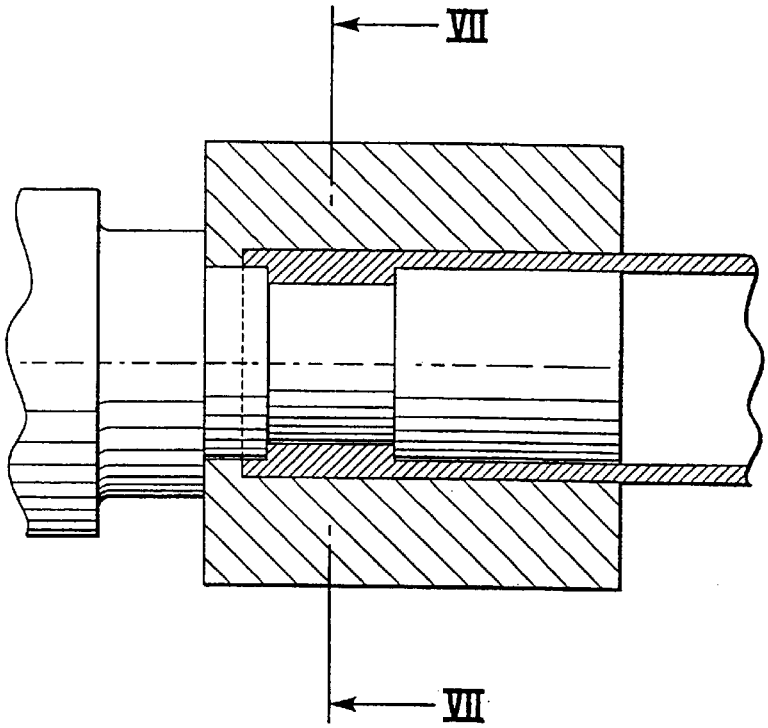
FIG. 6 is a longitudinal section similar to that illustrated in FIG. 5, but where portions have been cut away and the bar has been upset.
Figure 7:
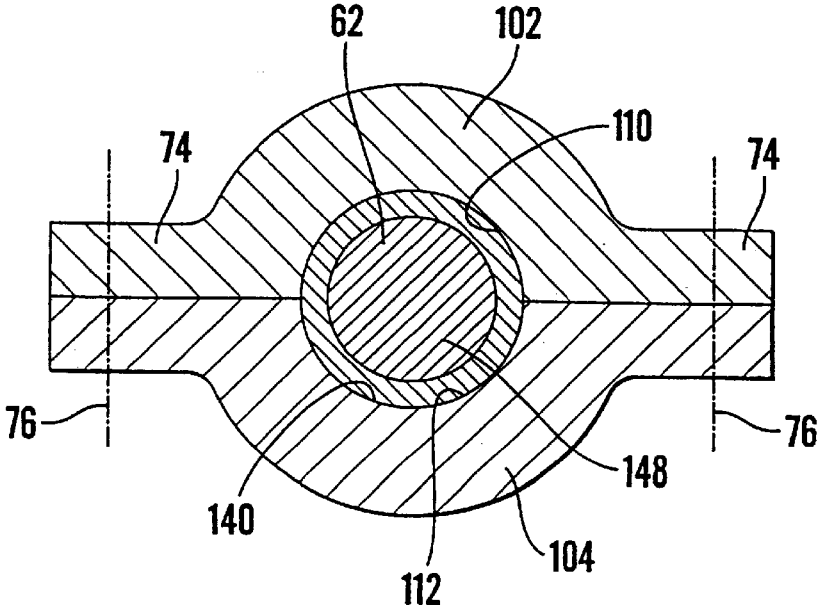
FIG. 7 is a section along line VII—VII in FIG. 6.

A second embodiment of a tool according to the invention is illustrated in FIGS. 5–7, where the reference numerals for components with the same function as components according to FIGS. 1–4 have been increased by 100.

In this embodiment the object of forging is to connect a first end portion of a tubular bar or cavity profile with a piece which is adapted to the bar as indicated below, in order to prevent the bar from being pulled axially away from the piece or being rotated about its longitudinal axis relative to the piece.

As illustrated in FIGS. 5–7 the tool therefore comprises an elongated, e.g. machined piece 60, one end portion of which forms a core portion or core 62, whose cross sectional contour corresponds to the inner contour of the cross section of a tubular bar 148. The core 62 has a narrowing 64, and at a distance therefrom the piece has a stop 66 which extends radially outwards and faces the core 62. The portion of the core's surface which is located between the narrowing 64 and the stop 66 forms an axially extending, first support surface 68.

On the outside of the core 62 can be mounted two tool halves 102, 104 with channel-shaped passage portions 110, 112 which, when the halves are joined, form a passage 140 whose cross sectional contour corresponds to the outer contour of the bar's cross section. At one end the tool halves 102, 104 have respective wall portions which together form a wall or wall part 142 with a hole whose contour corresponds to the outer contour of the first support surface's cross section, and whose surface forms a second support surface 70. The length of the tool halves 102, 104 corresponds to the length of the core 62.

When the tool halves 102, 104 are joined and the outside of the wall 142 abuts against the stop 66, the second support surface 70 comes into abutment against the first support surface 68, resulting in an alignment of the tool half assembly 102, 104 axially relative to the core 62. Furthermore, between the core 62 and the tool half assembly there is formed an aperture 72 with cross section corresponding to the cross section of the bar 148 and an enlarged cavity 144 at the narrowing 64.

A piston 152 of a hydraulic cylinder 150 can be brought into abutment against the end of the piece 60 which faces away from the core 62, and at the opposite side of the piece at a distance therefrom there can be provided a stop 154.

If a bar 148 has to be fixed to the core 62 of the piece 60, an end portion of the bar is first heated to forging temperature and inserted in the aperture 72, whereupon the piston 152 is brought into abutment against the piece 60 and the stop 154 brought into abutment against the bar 148 as illustrated in FIG. 5. The hydraulic cylinder 150 is then activated, whereupon the piece 60 and the bar 148 are moved axially relative to each other. The end of the end portion 146 of the bar thereby comes into abutment against the wall 142, and the portion of the bar which is located at the cavity 144, and portions of the bar which are consecutively brought into this cavity, are deformed by forging and brought into the cavity and forced radially inwards to forceful abutment against this portion of the core 62, as illustrated in FIG. 6.

After the cavity has become filled with bar material, the tool halves are separated from each other and the bar/piece assembly removed, the bar and the piece now being fixed to each other, thus preventing them from being moved relative to each other in the axial direction. To some extent they are also rigidly connected with each other with respect to rotation. If it is required that the piece 60 and the bar 148 should be capable of withstanding substantial torsion moments without being rotated relative to each other, the narrowed portion of the core can differ in cross section from a circular shape, and may, e.g., be of an elongated shape, such as elliptical, or it may have a polygonal shape or the like. Moreover, the cross section of the cavity 144 may differ in longitudinal section from a rectangular shape, and may, e.g. be meander shaped.

The tool halves may be provided with flanges 74 which can be held together by means of screws which are represented by the centre lines 76. By means of the method and the tool according to the invention it is ensured that the bar portion which has to be upset is deformed symmetrically about the bar's longitudinal axis and without folds, even though the bar portion which has to be deformed is long. A repeatable and predictable deformation of the bar is obtained and therefore also a predictable bonding thereof under static as well as dynamic loading.

What is claimed is:

1. In a method for forming a head on a bar by upset forging of a bar end portion by heating the bar end portion to the forging temperature of the bar material while an adjacent portion of the bar is not heated to the forging temperature, introducing the bar into a passage of a forming part with a cavity of a cross sectional area larger than that of the passage, a portion of the cavity located opposite the passage being defined by a wall, and moving the wall relative to the bar in the direction of the heated end portion, thereby upsetting the end portion until the bar material fills the cavity, the improvement comprising:

heating the complete bar end portion to the forging temperature outside the forming part;

placing the bar end portion in the cavity and in the passage so that a free end of the end portion abuts the wall and the adjacent bar portion is located in the passage;

moving the forming part relative to the bar while maintaining the shape of the cavity; and simultaneously with such moving, progressively feeding the bar portion that is located in the passage, and at the forging temperature, into the cavity during the upsetting process.

2. The method according to claim 1, including passing a punch through a bore in the wall towards and into the bar, thereby forming a recess in the end portion of the bar facing the wall, the recess extending parallel to the longitudinal axis of the bar.

3. The method according to claim 1 or 2, including simultaneously forming a head portion at both ends of the bar.

4. A tool for forming a bar head by upsetting an end portion of a bar by heating the bar end portion to the forging temperature of the bar material while an adjacent portion of the bar is not heated to the forging temperature, by introducing the bar into a passage of a forming part with a cavity of a cross sectional area larger than that of the passage, a portion of the cavity located opposite the passage being defined by a wall, and by moving the wall relative to the bar in the direction of the bar end, thereby upsetting the bar end portion until the bar material fills the cavity to form an interconnection between the bar end portion and a pin portion of another piece axially inserted therein by plastic compression of the material of the bar in a recess in the pin portion that is transverse to the axial direction at a distance from the end of the pin portion, the tool comprising:

means for defining the pin portion to be insertable into the forming part so that the forming part overlaps the recess and abuts against a shoulder of the pin portion facing the end of the pin portion; and means for defining an axially extending annulus between the pin portion and the forming part and having a bottom, a portion of the annulus located between the forming part and an area of the pin portion situated between the end of the pin and the recess forming the passage, and the recess and the forming part defining the cavity, and the bottom forming the wall.

* * * * *